United States Patent [19]

Elliott et al.

[11] 4,362,092

[45] Dec. 7, 1982

[54] AUXILIARY VENTILATION SYSTEM FOR UNDERGROUND SITES

[76] Inventors: Gordon Elliott, Elm Rd., Ponteland, Northumberland; Stephen Elliott, 13 Corbridge Ave. Woodlands Park Estate, Wideopen, Gosforth, Newcastle Upon Tyne; Frank Elliott, 53 Willoughby Dr., Woodburn Estate, Whitley Bay, Tyne & Wear, all of England

[21] Appl. No.: 307,527

[22] Filed: Oct. 1, 1981

[30] Foreign Application Priority Data

Oct. 6, 1980 [GB] United Kingdom ..... 8032100

[51] Int. Cl.[3] ..... E21F 1/00

[52] U.S. Cl. ..... 98/50; 98/33 R; 137/597

[58] Field of Search ..... 98/32, 33 R, 50; 137/597

[56] References Cited

U.S. PATENT DOCUMENTS

| | | | |
|---|---|---|---|
| 720,264 | 2/1903 | Lepley | 98/50 X |
| 752,955 | 2/1904 | Clifford | 98/50 |
| 1,695,784 | 12/1928 | Sternberg | 98/33 R |
| 1,695,804 | 12/1928 | Feinberg | 98/33 R |
| 1,917,439 | 7/1933 | Driggs | 98/50 |
| 2,011,117 | 8/1935 | Richter | 98/33 R |
| 2,214,736 | 9/1940 | Carmichael et al. | 137/597 X |

FOREIGN PATENT DOCUMENTS

| | | | |
|---|---|---|---|
| 95816 | 1/1960 | Norway | 98/39 |
| 756029 | 8/1980 | U.S.S.R. | 98/50 |

*Primary Examiner*—Albert J. Makay
*Assistant Examiner*—Harold Joyce
*Attorney, Agent, or Firm*—Austin R. Miller

[57] ABSTRACT

An auxiliary ventilation system for an underground site comprises an air box through which extend first and second chambers each having inlet and outlet ports and being in communication with one another. Flap members are mounted one in each chamber to be pivotal, about associated axes extending centrally of the flap members and transversely of the chambers, between first positions permitting substantially axial flow through each chamber from its inlet port to its outlet port, and second positions defining a passage through the air box from the inlet port of the first chamber to the inlet port of the second chamber. Means, preferably in the form of a further flap member, are provided which are movable with said flap members to seal the chambers from one another with said flap members in their first positions and to interconnect said chambers with the flap members in their second positions.

6 Claims, 4 Drawing Figures

AUXILIARY VENTILATION SYSTEM FOR UNDERGROUND SITES

BACKGROUND OF THE INVENTION

This invention relates to ventilation systems and more particularly to auxiliary systems provided in underground mine roadways and the like situations to supplement the primary ventilation therein.

It is essential that adequate air ventilation is provided when driving underground roadways particularly at and adjacent a face being mined, and it is now common practice for the primary ventilation provided by large suitably-positioned fans to be supplemented by auxiliary ventilation systems.

Such auxiliary ventilation systems usually consist of a first fan remote from the mined face to which is attached a first length of ducting extending to the face, air being forced through said ducting to ventilate the region of said face.

As well as ventilating the face, it is sometimes necessary to remove the dust therefrom, and accordingly auxiliary ventilation systems usually further consist of a second suction fan remote from the face to which is attached a further length of exhaust ducting extending from the face.

However, as the roadway progresses and the mined face proceeds away from the fans, it becomes necessary to extend both the first and further lengths of ducting to maintain adequate ventilation and dust suppression at the face.

Although the first length of ducting through which air is being forced, can comprise lay-flat tubing—i.e. non-reinforced, smooth-faced cylindrical tubing—the further length of ducting, being for exhaust purposes, must be the more expensive rigid or spirally-reinforced pvc-type tubing. Thus the cost of extending the ventilation ducting as the face proceeds can be substantial, while the inconvenience of having to extend two separate lengths of ducting will be readily appreciated.

It has been proposed to reduce these and other problems in such underground application by providing an air box within the auxiliary ventilation system for location at or adjacent a face and which only requires the addition of one extra length of ducting (which length my itself consist of a series of interconnected units of ducting) as a face proceeds but which enables the maintenance of adequate ventilation and dust suppression at the face.

More particularly, such a box includes a pair of communicating chambers therein, one chamber having an inlet port thereto to which is connected said first length of forcing ducting and an outlet port therefrom for ventilating air, and the other chamber having an outlet port to the same side of the box as the inlet port to the one chamber and to which is attached an exhaust fan, and an inlet port thereto through which dusty air from the face being mined can be drawn by said fan.

Each chamber has mounted therein a flap, said flaps being movable between first and second positions within their associated chambers. In their first positions, the flap in the one chamber seals off a communicating aperture between the two chambers while the flap in the other chamber is in an inoperative position, the arrangement being such that ventilating air can flow straight through the one chamber from the inlet port to the outlet port thereof, while exhaust air and dust can be drawn to flow straight through the other chamber from the inlet port to the outlet port thereof, the two chambers being sealed off one from the other.

On movement of the flaps to their second positions, the inlet to the one chamber is interconnected with the inlet to the other chamber by way of the communicating aperture between the two chambers, the outlet port from the one chamber and the outlet port and exhaust fan from the other chamber being redundant, whereby the only air flow path through the box is from one inlet port to the other inlet port. Thus ventilation can be achieved by forcing air from the inlet port to the one chamber and out of the inlet port to the other chamber, although the facility for exhausting air from the ventilated area is eliminated.

Initially, the above described air box is located adjacent a face being mined and the flaps are located in their first positions to enable ventilation and exhaust to be effected. As the face proceeds, spirally-reinforced or rigid ducting is attached to the inlet port to the other chamber to extend from the box to the face whereby dust can still be removed from the face while ventilating air continues to be emitted from the outlet port from the one chamber in sufficient quantity to effect ventilation at the face.

When the level of dust at a face is acceptable, such as when the machine is not cutting and during periods of inactivity at the face at weekends, the provision of exhaust facilities becomes unnecessary. Thus the flaps can be moved from their first positions to their second positions to effect a ventilating passage through the box from the one inlet port to the other inlet port and effective ventilation at the face can take place.

Thus it will be appreciated that the provision of such an air box reduces the additional ducting required as a face progresses, whilst still enabling effective ventilation of the progressed face at times when there is no dust problem. At other times, dust suppression is effected in combination with ventilating air being emitted at the region of the box itself. Periodically it will be necessary to move the air box and associated equipment and ducting bodily nearer the face to ensure adequate ventilation at said face.

A major disadvantage of the above-detailed known air box is the means by which the flaps are moved between their first positions and their second positions. More particularly each flap comprises a rectangular member in a square-section bore and is pivoted about its lower region which is located on the base of the associated chamber, the flaps being interconnected by a pivotal link extending between the flaps. The flaps are urged into their first positions by a heavy weight acting thereon, movement to the second positions being effected by an electrically-controlled hydraulic thrustor which acts against the weight to raise said weight and pivot the flaps. On de-activation of the thrustor, the weight falls under gravity and returns the thrustor and the flaps to their initial positions.

Clearly the use of a weight and a thrustor together with the associated ancillary equipment, all of which are bulky, adds to the size of the air box, while the presence of electrical power packs and mineral oil for the thrustor at a face can lead to potentially dangerous situations arising. Further, this known air box relies on a deadweight falling under gravity to return the flaps to their initial positions and therefore requires a vertical setting of the air box before correct operation will take place.

SUMMARY OF THE INVENTION

According to the present invention there is provided an auxiliary ventilation system for a mine or like underground site comprising an air box for location at a region to be ventilated, the air box including first and second chambers extending therethrough each having an associated inlet and outlet port, the intermediate regions of said chambers being in communication with one another, and a substantially flat flap member mounted in each of the chambers to be pivotal about an axis extending substantially centrally across the flap member and transversely of the chamber, said flap members each being pivotal about the associated axis between a first position extending substantially fore and aft of the associated chamber to permit substantially unimpeded flow between the inlet and outlet ports of said chamber and a second position making sealing engagement with the sidewalls of the associated chamber to define a passage through the box between the inlet port ot the first chamber and the inlet port to the second chamber, the air box further including means movable with the flap members to seal the first chamber from the second chamber when the flap members are in their first positions and to interconnect the intermediate regions of the first and second chambers when the flap members are in their second positions, an exhaust fan connected to the outlet port from the second chamber, and means for pivoting the flap members between their first and second positions.

Such an air box can be located adjacent a face being mined, and lay-flat forcing ducting connected to the inlet port of the first chamber. With the flap members in their first positions and the exhaust fan actuated, ventilating air can be forced from the outlet port of the first chamber while dusty air from the face is sucked through the second chamber thus establishing a steady re-circulation of air at the face.

As the face progresses, the ducting attached to the inlet port to the second chamber can be extended to maintain dust suppression at the face.

When ventilation only is required at a progressed face, it is a simple matter to pivot the flap members to their second positions whereby the ventilating air is forced through the exhaust ducting to the face, the exhaust fan being de-activated.

The central pivoting nature of the flap members enables the means for pivoting the flap members to be, for example, manual or electro-mechanical in nature, such as a rack and pinion or a worm drive, such an arrangement making the flap members much easier to actuate than if the whole flap members had to be bodily moved.

In a preferred box, the chambers are of circular cross-section and the flap members are elliptical in shape, the peripheral regions of the flap members coacting with associated correspondingly-shaped sealing means mounted on the internal sidewalls of the chambers to make sealed contact therewith when the flap members are at an angle of substantially 45° to the longitudinal axis of the associated chamber.

Conveniently the means movable with the flap members of the first and second chambers comprises a further flap member, the first, second and further flap members preferably being interconnected by links.

The first and second chambers may be releasably attached to one another to facilitate transport in confined situations underground, while movement of the flap members from their first positions to their second positions may be accompanied by automatic deactivation of the exhaust fans.

DESCRIPTION OF THE PREFERRED EMBODIMENT

Figure 1:
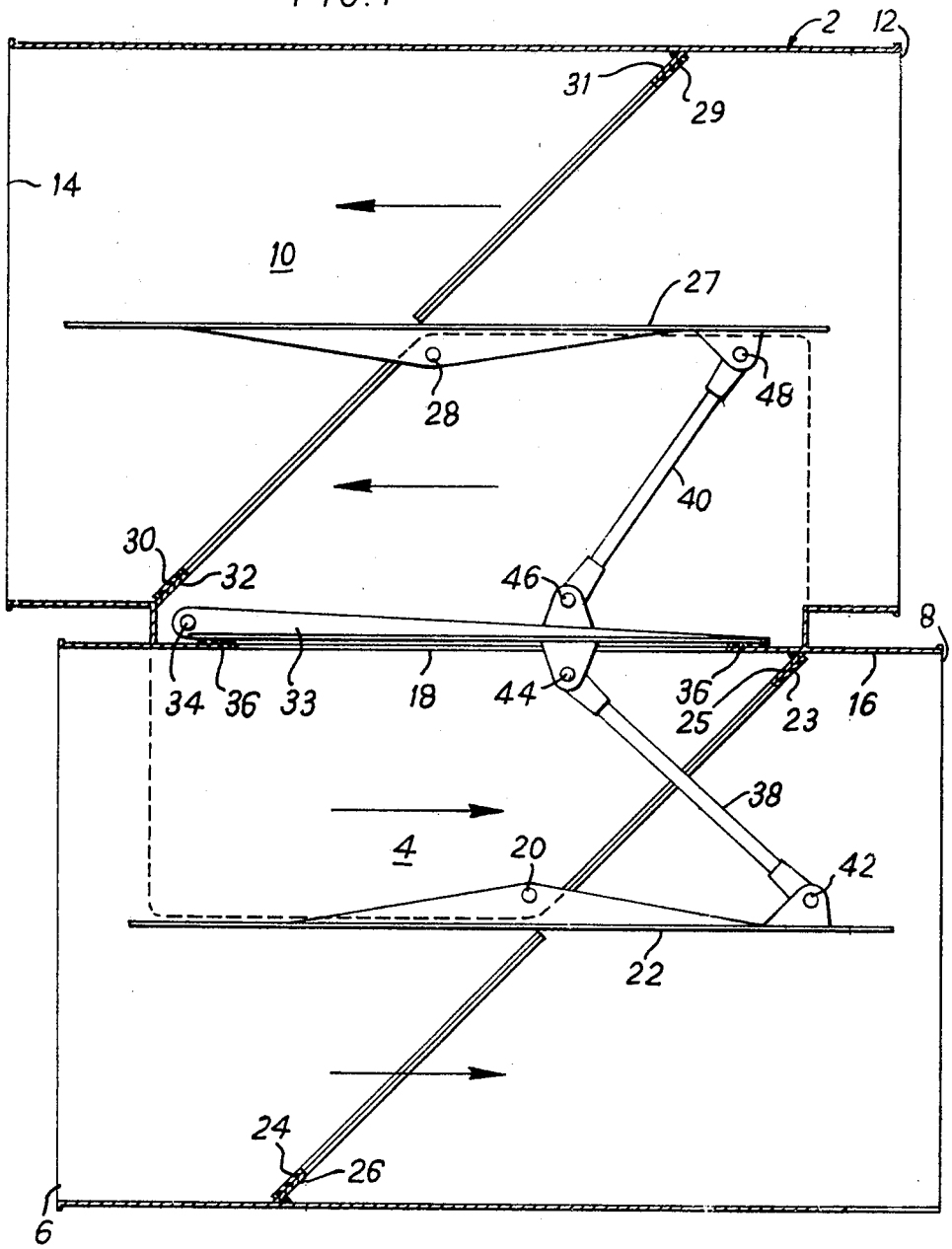
FIGS. 1 and 2 are vertical sections through part of an auxiliary ventilation system according to the invention with the flap members in their first and second positions respectively.

Referring to the drawings there is shown an air box indicated generally at 2 and comprising a lower cylindrical chamber 4 of circular cross-section provided with an inlet port 6 and an outlet port 8, and an upper cylindrical chamber 10 also of circular cross-section provided with an inlet port 12 and an outlet port 14.

A transverse wall 16 extends between the two chambers, said wall having an aperture 18 therein by which said chambers 4,10 are in communication with one another.

Figure 2:
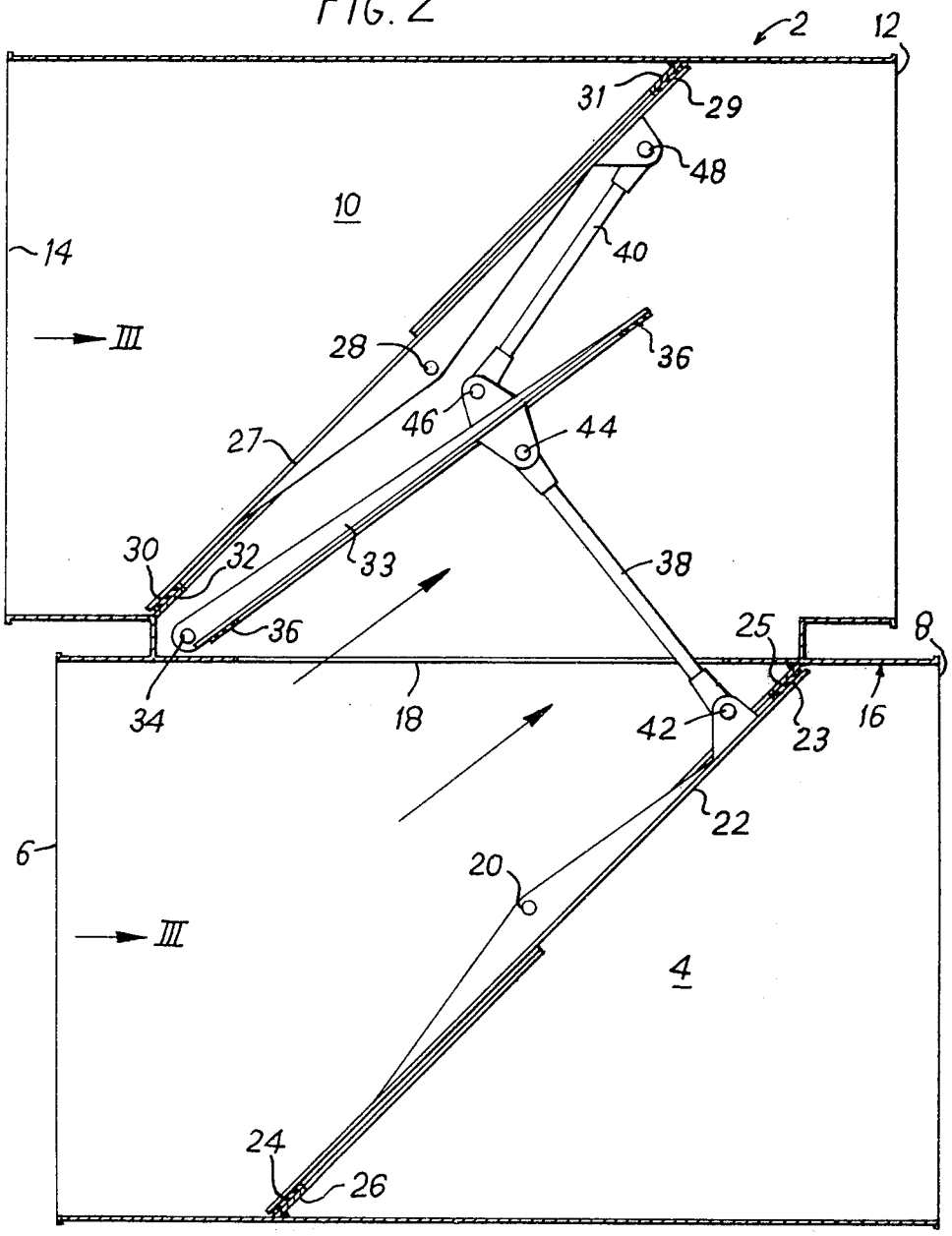

Mounted in the chamber 4 on an axle 20 extending diametrically across said chamber is an elliptical flap member 22 pivotal between a first position shown in FIG. 1 in which it extends substantially fore and aft of the chamber along the central longitudinal axis of the chamber and a second position shown in FIG. 2 in which the periphery fo the flap member 22 engages with, to seal against, each of a pair of semi-elliptical sealing rings 23,24 mounted on associated semi-elliptical metal support members 25,26 secured, for example by welding, to the inner surface of the chamber 4, to isolate the inlet and outlet ports 6,8 from one another, the flap member making an angle of about 45° with the longitudinal axis of the chamber.

Similarly chamber 10 incorporates an elliptical flap member 27 pivotal about an axle 28 extending diametrically across said chamber between a first position shown in FIG. 1 in which the flap member 27 extends substantially fore and aft of the chamber 10 along the central longitudinal axis thereof and a second position shown in FIG. 2 in which the periphery of the flap member 27 engages with, to seal against, each of a pair of semi-elliptical sealing rings 29,30 mounted on associated semi-elliptical metal support members 31,32 secured, for example by welding, to the inner surface of the chamber 10 to seal the inlet port 12 and outlet port 14 from each other.

A further flap member, shown at 33, is pivotal about an axle 34 extending transversely of the air box 2 just behind and above one end of the aperture 18 in the wall 16. FIG. 1 shows the flap member 33 in a first position in which said flap member 33 seats over, to close said aperture 18, a resilient flange 36 on the flap member 33 seating against the region of the wall 16 bounding the aperture 18 to effect said closure. In this position of the flap member 33, the chambers 4 and 10 are thus sealed from one another.

The flap member 33 is pivotal from said first position to a second position shown in FIG. 2 in which said member lies substantially parallel with the flap member 27 thereby opening the aperture 18 and bringing the chambers 4,10 into communication with each other.

The flap members 22,27 and 33 are interconnected with one another by a pair of pivotal links 38,40 arranged to ensure that the three flap members all move together in the desired manner between the first and second positions.

More particularly, one end of link 38 is pivotally connected at 42 to the upper surface of the flap member 22 while the other end of said link 38 is pivotally connected at 44 to an intermediate region of the lower surface of the flap member 33.

One end of the link 40 is pivotally connected at 46 to the upper surface of the flap member 33 while the other end of said link 40 is pivotally connected at 48 to the lower surface of the flap member 27.

The positioning and lengths of the links 38,40 are such that, with the flap members in the positions shown in FIG. 1 and on rotation of the axle 28 by suitable means, the flap member 27 is pivoted in an anti-clockwise direction as viewed in FIG. 1 from the horizontal position to the position shown in FIG. 2 in which the periphery of the flap member 27 seals against the inner resilient sealing rings 29,30 on the inner surface of the chamber 10.

As the flap member 27 is pivoted, the link 40 rises and draws with it the flap member 33 which is thus pivoted about the axle 34, again in an anti-clockwise direction as viewed in FIG. 1, to the fully displaced position shown in FIG. 2 in which it lies just below and substantially parallel with the flap member 27.

Said pivoting of the flap member 33 causes the link 38 to rise and carry with it the flap member 22 which is thus pivoted about its axle 20 to reach its sealing position shown in FIG. 2 at the same time as the flap member 27 reaches its sealing position.

Thus it will be appreciated that, in a similar manner to that described with reference to the known air box, the air box of the invention can be located at a face being mined to enable ventilation and dust suppression at said face.

More particularly the air box is positioned adjacent a face being mined, with one end of a length of forcing ducting connected to the inlet port 6 of the chamber 4, a fan being connected to the other end of said ducting. The outlet 8 faces the mined face. An exhaust fan is attached to the outlet port 14 from the chamber 10, the inlet 12 to said chamber also facing said face with a length of spiral reinforced or rigid exhaust ducting extending from said inlet 12 to a position adjacent the face.

Thus, with the flap members as shown in FIG. 1, fresh air can be fed from the forcing ducting through the chamber 4 to ventilate the face while dusty air at the face can be drawn through the chamber 10 to effect controlled circulation and recirculation of air to and from said face, the chambers 4,10 being sealed from one another by the flap member 33.

It will be appreciated that the flap members 22,27, being horizontally disposed within the chambers 4,10, present very little interference to the flow of air through said chambers.

As the face progresses, further lengths of spiral reinforced or rigid exhaust ducting can be attached to the exhaust ducting from inlet port 12 to the chamber 10 to extend to a position adjacent the progressed face whereby dusty air can still be exhausted from the face, while fresh ventilating air continues to be emitted from the outlet port 8 of chamber 4 in the region of the air box but in sufficient quantity and at sufficient pressure to effect adequate ventilation at the face.

When ventilation only, without dust suppression, is required at a face, such as during periods of inactivity at weekends, the flap members 22,27,33 are moved to the positions shown in FIG. 2 whereby the chambers 4,10 are interconnected with one another by way of the aperture 18 and the passageways between the inlet ports 6,12 and the associated outlet ports 8,14 are sealed. Thus ventilating air from inlet port 6 flows through the air box to exit from inlet 12 and flows along the exhaust ducting to the face to provide ventilation actually at the face—clearly the outlet 8 from the chamber 4, the outlet 14 from chamber 10 and the exhaust fan attached to outlet 14 are redundant in such a situation.

Figure 3:
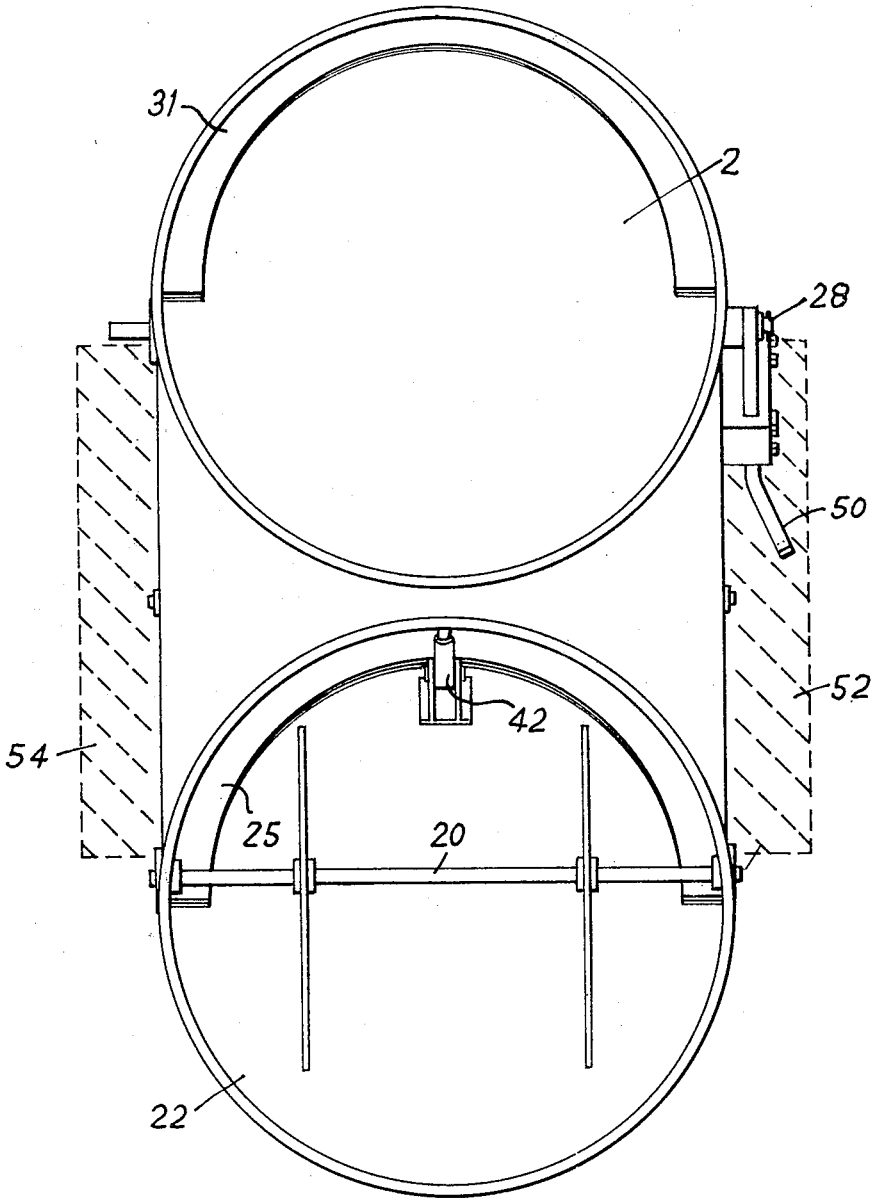
FIG. 3 is a view in the direction of arrow III of FIG. 2.
Figure 4:
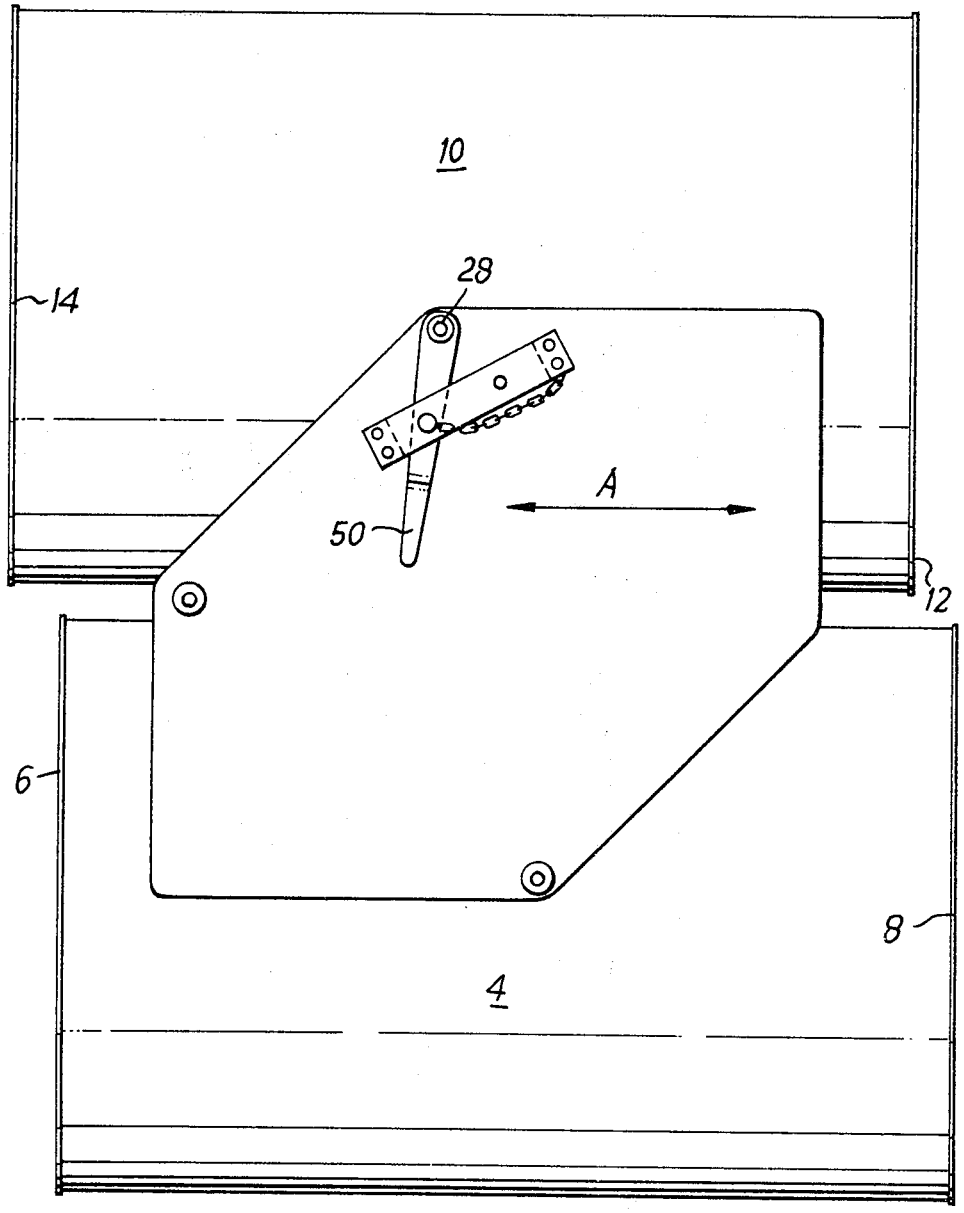
FIG.4 is an external side view of the part of the system shown in FIGS.1 to 5.

That the flap members 22 and 27 are pivotal about axles extending centrally of the members means that the force necessary to effect said pivoting is much less than that required for flap members pivotal about axes extending through peripheral regions thereof as is the case in known arrangements—further, there is a much lighter loading on the flap members during pivoting, while said members are much easier to actuate. Preferably the axle 20 is rotated manually by means of a handle 50 outside the air box 2 and attached to, to form an extension of, the axle 28. The handle can be locked, as shown in FIG. 4, with the flap members 22,27,33 in positions corresponding with those shown in FIGS. 1 or 2. Alternatively, relatively low power electric motors incorporating, for example, worm drives, rack and pinion drives or direct drives with a return spring acting on axle 28 could be used to effect rotation of axle 28. As a further possibility, readily available compressed air rams acting along the line of force A—A in FIG. 4 could be used. None of the actuating mechanisms rely on gravity and accordingly, unlike the above-detailed known arrangement, said mechanisms could be located anywhere in any orientation either adjacent to or remote from the air box. The actuating mechanisms could be located on the other sidewall of the box 2 from that shown in FIGS. 3 and 4, while the shaded areas 52,54 in FIG. 3 indicate the potential areas available for locating non-manually operated mechanisms without adding substantially to the dimensions of the air box.

In all cases, the mechanism for effecting pivoting of the flap members may be electrically linked to the exhaust fan whereby said fan is deactivated when said members are in the position shown in FIG. 2.

The air box need not be positioned vertically as shown in the drawings, but could be otherwise orientated as its operation is not affected by gravity.

The air box 2 may be split into two components, one containing chamber 4 and the other containing chamber 10, for ease of transport particularly underground where space is limited. Other modifications and variations of the illustrated air box will be apparent to those skilled in the art.

The construction and operation of the above-described ventilation system is such as to enable it to be much lighter, cheaper and more compact than known arrangements, with the result that it takes up less of the already limited roadway space and eliminates the necessity for heavy lifting equipment. The centrally pivoting nature of the flap members enables said members to be of relatively light gauge material whereby they can be readily operated manually, thus eliminating the necessity for expensive actuating equipment which may incorporate controversial electronic and/or hydraulic linkages that could in themselves cause safety problems. Further, and as mentioned above, operation of the system is in no way dependent upon gravity, permitting location of the air box in any orientation.

The air box may be free-standing on feet or it may be mounted on wheels to facilitate movement along a roadway. Alternatively the relatively light weight of the box and its relatively compact size, allow it to be suspended on a monorail extending along the roadway, thus further facilitating movement of the box as the face progresses.

What we claim and desire to secure by Letters Patent is:

1. An auxiliary ventilation system for an underground site comprising an air box for location at a region to be ventilated, first and second chambers extending through said air box, an inlet port and an outlet port associated with each of said chambers, the intermediate regions of said chambers being in communication with one another, and a substantially flat flap member mounted in each of the chambers to be pivotal about an axis extending substantially centrally across the flap member and transversely of the chamber, said flap members each being pivotal about the associated axis between a first position extending substantially fore and aft of the associated chamber to permit substantially unimpeded flow between the inlet and outlet ports of said chamber and a second position making sealing engagement with the sidewalls of the associated chamber to define a passage through the box between the inlet port to the first chamber and the inlet port to the second chamber, the air box further including means movable with the flap members to seal the first chamber from the second chamber when the flap members are in their first positions and to interconnect the intermediate regions of the first and second chambers when the flap members are in their second positions, an exhaust fan connected to the outlet port from the second chamber, and means for pivoting the flap members between their first and second positions.

2. A ventilation system as claimed in claim 1 in which the chambers are of circular cross-section and the flap members are elliptical in shape, correspondingly shaped sealing means being mounted on the internal sidewalls of the chambers for engagement by the peripheral regions of the flap members whereby said flap members make sealing contact with said sealing means when the flap members are at an angle of substantially 45° to the longitudinal axis of the associated chamber.

3. A ventilation system as claimed in claim 1 in which the means movable with the flap members of the first and second chambers comprises a further flap member, links interconnecting said flap members with said further flap member.

4. A ventilation system as claimed in claim 1 in which the first and second chambers are releasably attached to one another.

5. A ventilation system as claimed in claim 1 in which movement of the flap members from their first positions to their second positions is accompanied by automatic deactivation of the exhaust fan.

6. A ventilation system as claimed in claim 1 in which the means for pivoting the flap members comprises a manually operable handle external of said chambers and secured to one of said flap members to form a continuation of the axis about which said one flap member pivots.

* * * * *